US010450625B2

(12) United States Patent
Fukuda et al.

(10) Patent No.: US 10,450,625 B2
(45) Date of Patent: *Oct. 22, 2019

(54) FERRITIC STAINLESS STEEL AND METHOD FOR PRODUCING SAME

(71) Applicant: JFE STEEL CORPORATION, Chiyoda-ku, Tokyo (JP)

(72) Inventors: Kunio Fukuda, Tokyo (JP); Mitsuyuki Fujisawa, Tokyo (JP); Tomohiro Ishii, Tokyo (JP); Shin Ishikawa, Tokyo (JP); Chikara Kami, Tokyo (JP)

(73) Assignee: JFE STEEL CORPORATION, Chiyoda-ku, Tokyo (JP)

( * ) Notice: Subject to any disclaimer, the term of this patent is extended or adjusted under 35 U.S.C. 154(b) by 191 days.

This patent is subject to a terminal disclaimer.

(21) Appl. No.: 15/325,145

(22) PCT Filed: Jul. 23, 2015

(86) PCT No.: PCT/JP2015/003695

§ 371 (c)(1),
(2) Date: Jan. 10, 2017

(87) PCT Pub. No.: WO2016/017123

PCT Pub. Date: Feb. 4, 2016

(65) Prior Publication Data

US 2017/0183752 A1 Jun. 29, 2017

(30) Foreign Application Priority Data

Jul. 31, 2014 (JP) ..... 2014-156609

(51) Int. Cl.
*C21D 9/46* (2006.01)
*C23C 8/26* (2006.01)
(Continued)

(52) U.S. Cl.
CPC ..... *C21D 9/46* (2013.01); *C21D 6/004* (2013.01); *C21D 8/0226* (2013.01);
(Continued)

(58) Field of Classification Search
None
See application file for complete search history.

(56) References Cited

U.S. PATENT DOCUMENTS 5,512,239 A 4/1996 Fujiwara et al.
5,626,694 A 5/1997 Kawabata et al.
(Continued)

FOREIGN PATENT DOCUMENTS

CN 102131946 A 7/2011
CN 103643136 A 3/2014
(Continued)

OTHER PUBLICATIONS

Jun. 19, 2018, Office Action issued by the Korean Intellectual Property Office in the corresponding Korean Patent Application No. 10-2017-7004587 with English language concise statement of relevance.
(Continued)

*Primary Examiner* — Keith Walker
*Assistant Examiner* — Adil A. Siddiqui
(74) *Attorney, Agent, or Firm* — Kenja IP Law PC

(57) ABSTRACT

Provided is a ferritic stainless steel that has excellent corrosion resistance and displays good brazing properties when brazing is carried out at high temperature using a Ni-containing brazing metal. These effects are obtained as a result of the steel having a chemical composition containing, in mass %: 0.003%-0.020% of C; 0.05%-1.00% of Si; 0.10%-0.50% of Mn, 0.04% or less of P; 0.01% or less of S; 16.0%-25.0% of Cr; 0.05%-0.60% of Ni; 0.25%-0.45% of Nb; 0.005%-0.15% of Al; 0.005%-0.030% of N; and at least one selected from 0.50%-2.50% of Mo and 0.05%-0.80% of Cu, the balance being Fe and incidental impurities, and as a result of a nitrogen-enriched layer being created that has a nitrogen concentration peak value of 0.03 to 0.30 mass % at a depth of within 0.05 μm of a surface of the steel.

4 Claims, 2 Drawing Sheets

(51) Int. Cl.

| | |
|---|---|
| ***C22C 38/54*** | (2006.01) |
| ***C22C 38/50*** | (2006.01) |
| ***C22C 38/48*** | (2006.01) |
| ***C21D 6/00*** | (2006.01) |
| ***C22C 38/44*** | (2006.01) |
| ***C22C 38/42*** | (2006.01) |
| ***C22C 38/06*** | (2006.01) |
| ***C22C 38/04*** | (2006.01) |
| ***C22C 38/02*** | (2006.01) |
| ***C22C 38/00*** | (2006.01) |
| ***C21D 8/02*** | (2006.01) |
| ***C22C 38/46*** | (2006.01) |

(52) U.S. Cl.

CPC ..... *C21D 8/0236* (2013.01); *C21D 8/0273* (2013.01); *C21D 8/0278* (2013.01); *C22C 38/00* (2013.01); *C22C 38/001* (2013.01); *C22C 38/002* (2013.01); *C22C 38/004* (2013.01); *C22C 38/02* (2013.01); *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/54* (2013.01); *C23C 8/26* (2013.01); *C21D 2211/005* (2013.01)

(56) References Cited

U.S. PATENT DOCUMENTS

| | | | | |
|---|---|---|---|---|
| 9,611,525 | B2 | 4/2017 | Hiraide et al. | |
| 2008/0057357 | A1* | 3/2008 | Uchiyama | C23C 8/26 429/467 |
| 2010/0061878 | A1 | 3/2010 | Fukuda et al. | |
| 2010/0272594 | A1 | 10/2010 | Hiraide | |
| 2011/0176953 | A1 | 7/2011 | Hiraide et al. | |
| 2012/0085513 | A1 | 4/2012 | Oku et al. | |
| 2014/0069619 | A1 | 3/2014 | Hiraide et al. | |
| 2015/0376732 | A1* | 12/2015 | Hamada | C21D 9/46 148/610 |
| 2017/0321310 | A1* | 11/2017 | Hatano | C21D 1/76 |

FOREIGN PATENT DOCUMENTS

| | | | | |
|---|---|---|---|---|
| JP | S5861220 | A | | 4/1983 |
| JP | S6013060 | A | | 1/1985 |
| JP | H01168811 | A | | 7/1989 |
| JP | H01176094 | A | | 7/1989 |
| JP | H07216447 | A | | 8/1995 |
| JP | H07292446 | A | | 11/1995 |
| JP | H08109443 | A | | 4/1996 |
| JP | H10176249 | A | | 6/1998 |
| JP | H11236654 | | * | 8/1999 |
| JP | 2000212704 | A | | 8/2000 |
| JP | 2001032051 | A | | 2/2001 |
| JP | 2008001945 | A | | 1/2008 |
| JP | 2008190035 | A | | 8/2008 |
| JP | 2009174040 | A | | 8/2009 |
| JP | 2009197293 | A | | 9/2009 |
| JP | 2009228036 | A | | 10/2009 |
| JP | 2010121208 | A | | 6/2010 |
| JP | 2010285683 | A | | 12/2010 |
| JP | 2013014796 | A | | 1/2013 |
| KR | 1020130125823 | A | | 11/2013 |
| WO | 2010047131 | A1 | | 4/2010 |
| WO | 2015141145 | A1 | | 9/2015 |

OTHER PUBLICATIONS

May 15, 2018, Office Action issued by the State Intellectual Property Office in the corresponding Chinese Patent Application No. 201580040887.X with English Search Report.

Oct. 11, 2017, Office Action issued by the State Intellectual Property Office in the corresponding Chinese Patent Application No. 201580040887.X with English language Search Report.

Sep. 1, 2017, Extended European Search Report issued by the European Patent Office in the corresponding European Patent Application No. 15828109.7.

Nov. 5, 2018, Office Action issued by the State Intellectual Property Office in the corresponding Chinese Patent Application No. 201580040887.X with English language concise statement of relevance.

Jul. 12, 2016, Office Action issued by the Japan Patent Office in the corresponding Japanese Patent Application No. 2016-523346 with English language statement of relevance.

Oct. 20, 2015, International Search Report issued in the International Patent Application No. PCT/JP2015/003695.

Mar. 4, 2016, Office Action issued by the Taiwan Intellectual Property Office in the corresponding Taiwanese Application No. 104124958 with English language Search Report.

Dec. 27, 2018, Office Action issued by the United States Patent and Trademark Office in the U.S. Appl. No. 15/538,335.

* cited by examiner

FERRITIC STAINLESS STEEL AND METHOD FOR PRODUCING SAME

TECHNICAL FIELD

The present disclosure relates to a ferritic stainless steel having excellent corrosion resistance and displaying good brazing properties when brazing is carried out at high temperature using a Ni-containing brazing metal, and to a method for producing the ferritic stainless steel.

BACKGROUND

In recent years, there has been demand for further improvement of automobile fuel efficiency and exhaust gas purification from a standpoint of environmental protection. Consequently, adoption of exhaust heat recovery units and EGR (Exhaust Gas Recirculation) coolers in automobiles continues to increase.

An exhaust heat recovery unit is an apparatus that improves fuel efficiency by, for example, using heat from engine coolant for automobile heating and using heat from exhaust gas to warm up engine coolant in order to shorten warming-up time when the engine is started up. The exhaust heat recovery unit is normally located between a catalytic converter and a muffler, and includes a heat exchanger part formed by a combination of pipes, plates, fins, side plates, and so forth, and entry and exit pipe parts. Usually, fins, plates, and the like have a small sheet thickness (about 0.1 mm to 0.5 mm) to reduce back pressure resistance, and side plates, pipes, and the like have a large sheet thickness (about 0.8 mm to 1.5 mm) to ensure strength. Exhaust gas enters the heat exchanger part through the entry pipe, transfers its heat to a coolant via a heat-transfer surface such as a fin, and is discharged from the exit pipe. Bonding and assembly of plates, fins, and so forth forming the heat exchanger part of an exhaust heat recovery unit such as explained above is mainly carried out by brazing using a Ni-containing brazing metal.

An EGR cooler includes a pipe for intake of exhaust gas from an exhaust manifold or the like, a pipe for returning the exhaust gas to a gas intake-side of an engine, and a heat exchanger for cooling the exhaust gas. The EGR cooler more specifically has a structure in which a heat exchanger including both a water flow passage and an exhaust gas flow passage is located on a path along which exhaust gas is returned to the gas intake-side of the engine from the exhaust manifold. Through the structure described above, high-temperature exhaust gas at the exhaust-side is cooled by the heat exchanger and the cooled exhaust gas is returned to the gas intake-side such as to lower the combustion temperature of the engine. Accordingly, this structure forms a system for inhibiting $NO_x$ production, which tends to occur at high temperatures. The heat exchanger part of the EGR cooler is made by overlapping thin fins and plates, for reductions in weight, size, cost, etc. Bonding and assembly of these thin plates is mainly carried out by brazing using a Ni-containing brazing metal.

Since bonding and assembly for a heat exchanger part in an exhaust heat recovery unit or an EGR cooler such as described above are carried out by brazing using a Ni-containing brazing metal, materials used in the heat exchanger part are expected to have good brazing properties with respect to the Ni-containing brazing metal. Moreover, a heat exchanger part such as described above is expected to be highly resistant to oxidation caused by high-temperature exhaust gas passing through the heat exchanger part. The exhaust gas includes small amounts of nitrogen oxides ($NO_x$), sulfur oxides ($SO_x$), and hydrocarbons (HC) that may condense in the heat exchanger to form a strongly acidic and corrosive condensate. Therefore, materials used in a heat exchanger part such as described above are expected to have corrosion resistance at normal temperatures. In particular, because brazing heat treatment is carried out at high temperature, it is necessary to prevent formation of a Cr depletion layer due to preferential reaction of Cr at grain boundaries with C and N, which is referred to as sensitization, in order to ensure that corrosion resistance is obtained.

For the reason described above, heat exchanger parts of exhaust heat recovery units and EGR coolers are normally made using an austenitic stainless steel such as SUS316L or SUS304L that has a reduced carbon content and is resistant to sensitization. However, austenitic stainless steels suffer from problems such as high cost due to having high Ni content, and also poor fatigue properties and poor thermal fatigue properties at high temperatures due to its large thermal expansion when used in an environment in which constraining force is received at high temperature and with violent vibration, such as when used as a component located peripherally to an exhaust manifold.

Therefore, steels other than austenitic stainless steels are being considered for use in heat exchanger parts of exhaust heat recovery units and EGR coolers.

For example, PTL 1 discloses, as a heat exchanger component of an exhaust heat recovery unit, a ferritic stainless steel in which Mo, Ti, or Nb are added and Si and Al content is reduced. PTL 1 discloses that addition of Ti or Nb prevents sensitization by stabilizing C and N in the steel as carbonitrides of Ti and Nb and that reduction of Si and Al content improves brazing properties.

PTL 2 discloses, as a component for a heat exchanger of an exhaust heat recovery unit, a ferritic stainless steel having excellent condensate corrosion resistance in which Mo content is defined by Cr content, and Ti and Nb content is defined by C and N content.

Furthermore, PTL 3 discloses, as a material for an EGR cooler, a ferritic stainless steel in which added amounts of components such as Cr, Cu, Al, and Ti satisfy a certain relationship.

Additionally, PTL 4 and 5 disclose, as a component of an EGR cooler and a material for a heat exchanger part of an EGR cooler, a ferritic stainless steel containing 0.3 mass % to 0.8 mass % of Nb and a ferritic stainless steel containing 0.2 mass % to 0.8 mass % of Nb.

CITATION LIST

Patent Literature

PTL 1: JP H7-292446 A
PTL 2: JP 2009-228036 A
PTL 3: JP 2010-121208 A
PTL 4: JP 2009-174040 A
PTL 5: JP 2010-285683 A
PTL 6: JP 2008-190035 A

SUMMARY

Technical Problem

However, there is a presumption that brazing of the steel disclosed in PTL 1 is carried out using a copper brazing metal having a low brazing temperature and inadequate brazing may, therefore, occur in a situation in which a Ni-containing brazing metal (for example, BNi-2 or BNi-5 stipulated by Japanese Industrial Standards (JIS Z 3265)) having a high brazing temperature is used.

The steel disclosed in PTL 2, particularly Al-containing steel, is problematic in that, when performing high-temperature brazing using a Ni-containing brazing metal, an Al oxide film which degrades the spreading property of the brazing metal forms to decrease the brazing property.

Furthermore, although the chemical composition of the steel disclosed by PTL 3 takes into account inhibition of Al oxide film formation during brazing at high temperature using a Ni-containing brazing metal, this inhibitive effect is not thought to be sufficient. Consequently, it has not achieved adequate brazing properties due to, for example, unsatisfactory joint strength or unsatisfactory brazing metal infiltration into a joint gap between overlapping parts when overlapping steel sheets is brazed.

In relation to this point, steel disclosed in PTL 4 and PTL 5 has a high Nb content in order to inhibit coarsening of crystal grains during brazing using a Ni-containing brazing metal and prevent reduction in toughness, and a certain degree of improvement of brazing properties is obtained in a situation in which Al is not contained in the steel.

In the case where Al is contained, however, the steel disclosed in each of PTL 4 and PTL 5 does not have a sufficient effect of suppressing the formation of an Al oxide film during high-temperature brazing using a Ni-containing brazing metal. Consequently, it has not achieved adequate brazing properties due to, for example, unsatisfactory joint strength or unsatisfactory brazing metal infiltration into a joint gap between overlapping parts when overlapping steel is brazed.

As disclosed in PTL 6, Al has an effect of suppressing degradation in corrosion resistance property of the weld by selectively forming Al oxide in the case of performing TIG welding. In view of this, it is effective if the steel contains a predetermined amount of Al.

The present disclosure is the result of development conducted in view of the circumstances described above and an objective thereof is to provide a ferritic stainless steel that has excellent corrosion resistance and displays good brazing properties when brazing is carried out at high temperature using a Ni-containing brazing metal even in a situation in which Al is contained in the steel, and also to provide a production method for this ferritic stainless steel.

Solution to Problem

Assuming that Al is contained, the inventors conducted diligent investigation in which they produced Al-containing ferritic stainless steel using various different chemical compositions and production conditions, and investigated various properties thereof, particularly brazing properties when brazing is carried out at high temperature using a Ni-containing brazing metal.

As a result of this investigation, the inventors discovered that it is possible to prevent formation of an oxide film of Al during brazing by optimizing the chemical composition and subjecting the steel to heat treatment in a controlled atmosphere prior to brazing such that a specific nitrogen-enriched layer is formed in a surface layer part of the steel. It was also discovered that through formation of this nitrogen-enriched layer, good brazing properties can be satisfactorily obtained even when brazing is carried out at high temperature using a Ni-containing brazing metal.

Based on these findings, the inventors conducted further investigation which eventually led to the present disclosure.

Specifically, the primary features of the present disclosure are as follows.

1. A ferritic stainless steel comprising a chemical composition containing (consisting of), in mass %:

0.003% to 0.020% of C;
0.05% to 1.00% of Si;
0.10% to 0.50% of Mn;
0.04% or less of P;
0.01% or less of S;
16.0% to 25.0% of Cr;
0.05% to 0.60% of Ni;
0.25% to 0.45% of Nb;
0.005% to 0.15% of Al;
0.005% to 0.030% of N; and at least one selected from 0.50% to 2.50% of Mo and 0.05% to 0.80% of Cu, the balance being Fe and incidental impurities, wherein a nitrogen-enriched layer is present that has a nitrogen concentration peak value of 0.03 mass % to 0.30 mass % at a depth of within 0.05 μm of a surface of the steel.

2. The ferritic stainless steel described above in 1, wherein the chemical composition further contains, in mass %, one or more of:

0.005% to 0.10% of Ti;
0.01% to 0.20% of V;
0.0003% to 0.0030% of Ca; and
0.0003% to 0.0030% of B.

3. A method for producing the ferritic stainless steel described above in 1 or 2, the method including:

hot rolling a slab having the chemical composition described above in 1 or 2 to form a hot-rolled sheet;

performing (hot-rolled sheet annealing on the hot-rolled sheet according to need; and performing a combination of cold rolling and annealing on (the hot-rolled sheet one or more times, wherein the hot-rolled sheet is heated in final annealing with a dew point of an atmosphere in a temperature range of 600° C. to 800° C. being −20° C. or lower, and subjected to a nitrogen-enriched layer creation treatment at a temperature of 890° C. or higher in an atmosphere of −20° C. or lower in dew point and 5 vol % or more in nitrogen concentration.

Advantageous Effect

According to the present disclosure, a ferritic stainless steel can be obtained that has excellent corrosion resistance and that displays good brazing properties when brazing is carried out at high temperature using a Ni-containing brazing metal.

BRIEF DESCRIPTION OF THE DRAWINGS

In the accompanying drawings:

FIG. 2 schematically illustrates a tensile test piece used to evaluate joint strength of a brazed part, wherein

DETAILED DESCRIPTION

Figure 1:
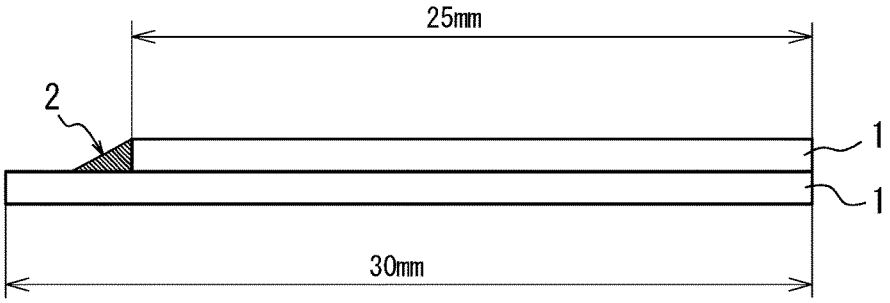
FIG. 1 is a schematic view illustrating a test material used to evaluated joint gap infiltration by a brazing metal.

The following provides a specific description of the present disclosure.

First, the reasons for limiting the chemical composition of the steel to the aforementioned range in the present disclosure are explained. Hereinafter, the unit "%" relating to the content of elements in the chemical composition of the steel refers to "mass %" unless specified otherwise.

C: 0.003% to 0.020%

Strength of the steel improves with increasing C content whereas workability of the steel improves with decreasing C content. Herein, the C content is required to be 0.003% or greater in order to obtain sufficient strength. However, if the C content is greater than 0.020%, workability noticeably decreases and sensitization tends to occur more easily due to Cr carbide precipitation at grain boundaries, promoting a decrease in corrosion resistance property. Accordingly, the C content is in a range of 0.003% to 0.020%. The C content is preferably in a range of 0.005% to 0.015%, and more preferably in a range of 0.005% to 0.010%.

Si: 0.05% to 1.00%

Si is a useful element as a deoxidizer. This effect is obtained through Si content of 0.05% or greater. However, if Si content is greater than 1.00%, workability noticeably decreases and forming becomes difficult. Accordingly, the Si content is in a range of 0.05% to 1.00%. The Si content is preferably in a range of 0.10% to 0.50%.

Mn: 0.10% to 0.50%

Mn has a deoxidizing effect that is obtained through Mn content of 0.10% or greater. However, excessive Mn addition leads to loss of workability due to solid solution strengthening. Furthermore, excessive Mn decreases corrosion resistance by promoting precipitation of MnS, which acts as a starting point for corrosion. Therefore, Mn content of 0.50% or less is appropriate. Accordingly, the Mn content is in a range of 0.10% to 0.50%. The Mn content is preferably in a range of 0.15% to 0.35%.

P: 0.04% or less

P is an element that is incidentally included in the steel. However, excessive P content reduces weldability and facilitates grain boundary corrosion. This trend is noticeable if the P content is greater than 0.04%. Accordingly, the P content is 0.04% or less. The P content is preferably 0.03% or less.

However, since excessive dephosphorization leads to increased refining time and costs, the P content is preferably 0.005% or greater.

S: 0.01% or less

S is an element that is incidentally contained in the steel, and that promotes MnS precipitation and decreases corrosion resistance if S content is greater than 0.01%. Accordingly, the S content is 0.01% or less. The S content is preferably 0.004% or less. Meanwhile, excessive desulfurization incurs longer refining time and higher cost, and so the S content is preferably 0.0005% or more.

Cr: 16.0% to 25.0%

Cr is an important element for ensuring corrosion resistance of the stainless steel. Adequate corrosion resistance after brazing is not obtained if Cr content is less than 16.0%. However, excessive addition of Cr causes deterioration of workability. Accordingly, the Cr content is in a range of 16.0% to 25.0%. The Cr content is preferably in a range of 18.0% to 19.5%.

Ni: 0.05% to 0.60%

Ni is an element that effectively contributes to improving toughness and to improving crevice corrosion resistance when contained in an amount of 0.05% or greater. However, Ni content of greater than 0.60% increases stress corrosion crack sensitivity. Furthermore, Ni is an expensive element that leads to increased costs. Accordingly, the Ni content is in a range of 0.05% to 0.60%. The Ni content is preferably in a range of 0.10% to 0.50%.

Nb: 0.25% to 0.45%

Nb is an element that combines with C and N and suppresses degradation of corrosion resistance property (sensitization) due to the precipitation of Cr carbonitride, in the same way as Ti described later. Nb also has an effect of creating the nitrogen-enriched layer by combining with nitrogen. These effects are obtained through Nb content of 0.25% or greater. However, if the Nb content exceeds 0.45%, weld cracking occurs easily in the weld. Accordingly, the Nb content is in a range of 0.25% to 0.45%. The Nb content is preferably in a range of 0.30% to 0.40%.

Al: 0.005% to 0.15%

Al is an element useful for deoxidation. Moreover, in the case of performing TIG welding, Al selectively forms Al oxide to prevent degradation in corrosion resistance of the weld. These effects are achieved when the Al content is 0.005% or more. If an Al oxide film forms in the steel surface during brazing, however, the spreading property and adhesion of the brazing metal decrease, making brazing difficult. Al oxide film formation during brazing is prevented in the present disclosure through creation of the nitrogen-enriched layer in the surface layer of the steel, but it is not possible to adequately prevent Al oxide film formation if Al content is greater than 0.15%. Accordingly, the Al content is in a range of 0.005% to 0.15%. The Al content is preferably in a range of 0.005% to 0.10%, and more preferably in a range of 0.005% to 0.04%.

N: 0.005% to 0.030%

N is an important element for preventing Al or Ti oxide film formation during brazing and improving brazing properties due to creation of the nitrogen-enriched layer. N content is required to be 0.005% or greater in order to create the nitrogen-enriched layer. However, N content of greater than 0.030% facilitates sensitization and reduces workability. Accordingly, the N content is in a range of 0.005% to 0.030%. The N content is preferably in a range of 0.007% to 0.025%, and more preferably in a range of 0.007% to 0.020%.

The ferritic stainless steel according to the disclosure also needs to contain at least one selected from 0.50% to 2.50% of Mo and 0.05% to 0.80% of Cu.

Mo: 0.50% to 2.50%

Mo improves corrosion resistance by stabilizing a passivation film of the stainless steel. In the case of an exhaust heat recovery unit or an EGR cooler, Mo has an effect of preventing inner surface corrosion caused by a condensate and outer surface corrosion caused by a snow-melting agent or the like. Furthermore, Mo has an effect of improving high-temperature thermal fatigue properties and is a particularly effective element in a situation in which the steel is used in an EGR cooler attached directly below an exhaust manifold. These effects are obtained through Mo content of 0.50% or greater. However, Mo content of greater than 2.50% reduces workability. Accordingly, the Mo content is in a range of 0.50% to 2.50%. The Mo content is preferably in a range of 1.00% to 2.00%.

Cu: 0.05% to 0.80%

Cu is an element that enhances corrosion resistance. This effect is obtained through Cu content of 0.05% or greater. However, Cu content of greater than 0.80% reduces hot workability. Accordingly, the Cu content is in a range of 0.05% to 0.80%. The Cu content is preferably in a range of 0.10% to 0.60%.

In addition to the basic components described above, the chemical composition in the present disclosure may appropriately further contain the following elements as required.

Ti: 0.005% to 0.10%

Ti is an element that prevents the precipitation of Cr carbonitride, which decreases corrosion resistance (sensitization), since Ti combines with C and N preferentially. This effect is obtained through Ti content of 0.005% or greater. However, Ti is not a preferable element from a viewpoint of brazing properties. The reason for this is that Ti is an active element with respect to oxygen and thus brazing properties are decreased as a result of a Ti oxide film being formed during brazing. Ti oxide film formation during brazing is prevented in the present disclosure through creation of a nitrogen-enriched layer in a surface layer of the steel, but brazing properties tend to be decreased if Ti content is greater than 0.10%. Accordingly, in a situation in which Ti is contained in the steel, the Ti content is in a range of 0.005% to 0.10%. The Ti content is preferably in a range of 0.005% to 0.05%.

V: 0.01% to 0.20%

V combines with C and N contained in the steel and prevents sensitization in the same way as Ti. V also has an effect of creating the nitrogen-enriched layer by combining with nitrogen. These effects are obtained through V content of 0.01% or greater. On the other hand, V content of greater than 0.20% reduces workability. Accordingly, in a situation in which V is contained in the steel, the V content is in a range of 0.01% to 0.20%. The V content is preferably in a range of 0.01% to 0.15%, and more preferably in a range of 0.01% to 0.10%.

Ca: 0.0003% to 0.0030%

Ca improves weldability by improving penetration of a welded part. This effect is obtained through Ca content of 0.0003% or greater. However, Ca content of greater than 0.0030% decreases corrosion resistance by combining with S to form CaS. Accordingly, in a situation in which Ca is contained in the steel, the Ca content is in a range of 0.0003% to 0.0030%. The Ca content is preferably in a range of 0.0005% to 0.0020%.

B: 0.0003% to 0.0030%

B is an element that improves resistance to secondary working brittleness. This effect is exhibited when B content is 0.0003% or greater. However, B content of greater than 0.0030% reduces ductility due to solid solution strengthening. Accordingly, in a situation in which B is contained in the steel, the B content is in a range of 0.0003% to 0.0030%.

Through the above description, the chemical composition of the presently disclosed ferritic stainless steel has been explained.

In the chemical composition according to the present disclosure, components other than those listed above are Fe and incidental impurities.

In the presently disclosed ferritic stainless steel, it is vital that the chemical composition of the steel is appropriately controlled such as to be in the range described above and that a nitrogen-enriched layer such as described below is created in the surface layer part of the steel by performing heat treatment in a controlled atmosphere prior to brazing.

Nitrogen concentration peak value at depth of within 0.05 μm of surface: 0.03 mass % to 0.30 mass %

In the presently disclosed ferritic stainless steel, a nitrogen-enriched layer is created that has a nitrogen concentration peak value of 0.03 mass % to 0.30 mass % at a depth of within 0.05 μm of the surface of the steel. This nitrogen-enriched layer can prevent formation of an oxide film of Al, Ti, or the like at the steel surface during brazing and, as a result, can improve brazing properties when a Ni-containing brazing metal is used.

N in the nitrogen-enriched layer described above combines with Ti, Al, V, Nb, Cr, and the like in the steel. The following describes a mechanism which the inventors consider to be responsible for the nitrogen-enriched layer inhibiting formation of an Al or Ti oxide film during brazing.

Specifically, formation of the nitrogen-enriched layer causes Al, Ti, or the like present in the surface layer part of the steel to combine with N such that the Ti and Al cannot diffuse to the surface of the steel. Furthermore, Al and Ti present inward of the nitrogen-enriched layer cannot diffuse to the surface of the steel because the nitrogen-enriched layer acts as a barrier. Accordingly, formation of an Al or Ti oxide film is inhibited as a result of Al and Ti in the steel not diffusing to the surface.

In the case of performing TIG welding, the steel surface melts and as a result the nitrogen-enriched layer formed in the surface layer part of the steel is destroyed. This allows selective formation of Al oxide in the weld, and prevents degradation in corrosion resistance of the weld.

Herein, formation of an Al or Ti oxide film at the steel surface cannot be adequately prevented during brazing if the nitrogen concentration peak value is less than 0.03 mass %. On the other hand, the surface layer part hardens if the nitrogen concentration peak value is greater than 0.30 mass %, making defects more likely to occur, such as fin plate cracking due to hot vibration of an engine or the like.

Therefore, the nitrogen concentration peak value at a depth of within 0.05 μm of the surface has a value in a range of 0.03 mass % to 0.30 mass %. The nitrogen concentration peak value is preferably in a range of 0.05 mass % to 0.20 mass %.

Note that the nitrogen concentration peak value at a depth of within 0.05 μm of the surface referred to herein can for example be calculated by measuring nitrogen concentration in the steel in a depth direction by glow discharge optical emission spectroscopy, dividing a maximum value for nitrogen concentration at a depth of within 0.05 μm of the steel surface by a measured value for nitrogen concentration at a depth of 0.50 μm, and multiplying the resultant value by the nitrogen concentration of the steel obtained though chemical analysis.

Furthermore, the nitrogen-enriched layer described herein refers to a region in which nitrogen is enriched due to permeation of nitrogen from the surface of the steel. The nitrogen-enriched layer is created in the surface layer part of the steel and more specifically in a region spanning for a depth of approximately 0.005 μm to 0.05 μm in the depth direction from the surface of the steel.

The following describes a suitable production method for the presently disclosed ferritic stainless steel.

Molten steel having the chemical composition described above is prepared by steelmaking through a commonly known method such as using a converter, an electric heating furnace, or a vacuum melting furnace, and is subjected to continuous casting or ingot casting and blooming to obtain a semi-finished casting product (slab).

The semi-finished casting product is hot rolled to obtain a hot-rolled sheet either directly without prior heating or after heating at 1100° C. to 1250° C. for 1 hour to 24 hours. The hot-rolled sheet is normally subjected to hot-rolled sheet annealing at 900° C. to 1100° C. for 1 minute to 10 minutes, but depending on the intended use, this hot-rolled sheet annealing may be omitted.

Thereafter, the hot-rolled sheet is subjected to a combination of cold rolling and annealing to obtain a product steel sheet.

The cold rolling is preferably performed with a rolling reduction rate of 50% or greater in order to improve shape correction, ductility, bendability, and press formability. Furthermore, the cold rolling and annealing process may be repeated two or more times.

Herein, it is necessary to create the above-described nitrogen-enriched layer in order to obtain the presently disclosed ferritic stainless steel. Treatment for creating the nitrogen-enriched layer is preferably performed (on the sheet after subjection to the cold rolling during final annealing (finish annealing) carried out after the cold rolling.

Note that treatment for creating the nitrogen-enriched layer can be performed in a separate step to annealing, such as, for example, after a component has been cut from the steel sheet. However, it is advantageous in terms of production efficiency to create the nitrogen-enriched layer during the final annealing (finish annealing) carried out after the cold rolling because this allows the nitrogen-enriched layer to be created without increasing the number of production steps.

The following describes conditions in treatment for creating the nitrogen-enriched layer.

Dew point: −20° C. or lower

If the dew point is higher than −20° C., a nitrogen-enriched layer is not created because nitrogen from the surrounding atmosphere does not permeate into the steel due to formation of an oxide film at the surface of the steel. Accordingly, the dew point is −20° C. or lower. The dew point is preferably −30° C. or lower, and more preferably −40° C. or lower. The lower limit is not particularly limited, but is typically about −55° C.

Treatment atmosphere nitrogen concentration: 5 vol % or greater

If the nitrogen concentration of the treatment atmosphere is less than 5 vol %, a nitrogen-enriched layer is not created because an insufficient amount of nitrogen permeates into the steel. Accordingly, the nitrogen concentration of the treatment atmosphere is 5 vol % or greater. The nitrogen concentration of the treatment atmosphere is preferably 10 vol % or greater. The remainder of the treatment atmosphere, besides nitrogen, is preferably one or more selected from hydrogen, helium, argon, neon, CO, and $CO_2$. The nitrogen concentration of the treatment atmosphere may be 100 vol %.

Treatment temperature: 890° C. or higher

If the treatment temperature is lower than 890° C., a nitrogen-enriched layer is not created because nitrogen in the treatment atmosphere does not permeate into the steel. Accordingly, the treatment temperature is 890° C. or higher. The treatment temperature is preferably 900° C. or higher. However, the treatment temperature is preferably 1100° C. or lower because a treatment temperature of higher than 1100° C. leads to deformation of the steel. The treatment temperature is more preferably 1050° C. or lower.

The treatment time is preferably in the range of 5 seconds to 3600 seconds. The reason for this is that nitrogen in the treatment atmosphere does not sufficiently permeate into the steel if the treatment time is shorter than 5 seconds, whereas the effects of treatment reach saturation if the treatment time is longer than 3600 seconds. The treatment time is preferably in a range of 30 seconds to 300 seconds.

Although the conditions of the nitrogen-enriched layer creation treatment have been described above, it is important to appropriately control not only the conditions of the nitrogen-enriched layer creation treatment but also the heating condition in the final annealing (i.e. the heating condition before the nitrogen-enriched layer creation treatment), in order to form a desired nitrogen-enriched layer.

Dew point of atmosphere in temperature range of 600° C. to 800° C. during heating in final annealing: −20° C. or lower If the dew point of the atmosphere in the temperature range of 600° C. to 800° C. during heating in the final annealing is high, an oxide forms in the steel surface. Such an oxide prevents the permeation of nitrogen in the atmosphere into the steel during the aforementioned nitrogen-enriched layer creation treatment. If such an oxide exists in the steel surface, the nitriding of the surface layer of the steel does not progress even when the conditions of the nitrogen-enriched layer creation treatment are appropriately controlled, making it difficult to form a desired nitrogen-enriched layer. The dew point of the atmosphere in the temperature range of 600° C. to 800° C. during heating in the final annealing is therefore −20° C. or lower, and preferably −35° C. or lower. The lower limit is not particularly limited, but is typically about −55° C.

Although descaling may be performed after final annealing (finish annealing) by normal pickling or polishing, from a viewpoint of production efficiency, it is preferable to perform descaling by adopting the high-speed pickling process in which mechanical grinding is performed using a brush roller, a polishing powder, shot blasting, or the like, and pickling is subsequently performed in a nitrohydrochloric acid solution.

In a situation in which treatment for creating the nitrogen-enriched layer is performed during final annealing (finish annealing), care should be taken to adjust the amount of pickling or polishing in order that the nitrogen-enriched layer that has been created is not removed.

EXAMPLES

Steels having the chemical compositions shown in Table 1 were each prepared by steelmaking using a 50 kg small vacuum melting furnace. Each resultant steel ingot was heated to 1150° C. in a furnace purged with Ar gas and was subsequently subjected to hot rolling to obtain a hot-rolled sheet having a thickness of 3.5 mm. Next, each of the hot-rolled sheets was subjected to hot-rolled sheet annealing at 1030° C. for 1 minute and shot blasting of the surface thereof with glass beads was performed. Thereafter, descaling was performed by carrying out pickling in which the sheet was immersed in a 200 g/l sulfuric acid solution at a temperature of 80° C. for 120 seconds and was subsequently immersed in a mixed acid of 150 g/l of nitric acid and 30 g/l of hydrofluoric acid at a temperature of 55° C. for 60 seconds.

Next, cold rolling was performed to reach a sheet thickness of 0.8 mm and annealing was subsequently performed under the conditions shown in Table 2 to obtain a cold-rolled and annealed sheet. In No. 1 to 19, the atmosphere in heating during annealing was adjusted to the same atmosphere gas as in the nitrogen-enriched layer creation treatment at a temperature lower than 600° C. In No. 20, heating in the temperature range of 600° C. to 800° C. was performed in an atmosphere of 75 vol % $H_2$+25 vol % $N_2$ gas with a dew point of −15° C., and the atmosphere was adjusted to the conditions of the nitrogen-enriched layer creation treatment shown in Table 2 at a temperature of 800° C. or higher.

Note that in a situation in which the external appearance of the sheet was deep yellow or blue, it was judged that a thick oxide film had been formed and +20 A/dm$^2$→−20 A/dm$^2$ electrolytic picking was performed twice, with different electrolysis times, in a mixed acid solution of 150 g/l of nitric acid and 5 g/l of hydrochloric acid at a temperature of 55° C.

Evaluation of (1) ductility and measurement of (2) nitrogen concentration at nitrogen-enriched layer were performed as described below for each cold-rolled and annealed sheet obtained as described above.

Furthermore, brazing was carried out for each cold-rolled and annealed sheet using a Ni-containing brazing metal and the cold-rolled and annealed sheet was evaluated after brazing in terms of (3) corrosion resistance and (4) brazing properties. The evaluation of (4) brazing properties was performed as described below for (a) joint gap infiltration of the brazing metal and (b) joint strength of a brazed part.

(1) Ductility Evaluation

A JIS No. 13B tensile test piece was sampled at a right angle to the rolling direction from each of the cold-rolled and annealed sheets described above, a tensile test was carried out in accordance with JIS Z 2241, and ductility was evaluated using the following standard. The evaluation results are shown in Table 2.

Good (pass): Elongation after fracture was 20% or greater

Poor (fail): Elongation after fracture was less than 20%

(2) Measurement of Nitrogen Concentration at Nitrogen-Enriched Layer

The surface of each of the cold-rolled and annealed sheets was analyzed by glow discharge optical emission spectroscopy (hereinafter referred to as GDS). First, samples with different sputtering times from the surface layer were prepared and cross-sections thereof were observed by SEM in order to prepare a calibration curve for a relationship between sputtering time and depth.

Nitrogen concentration was measured while performing sputtering from the surface of the steel to a depth of 0.50 μm. Herein, the measured values of Cr and Fe are fixed at the depth of 0.50 μm and thus a measured value for nitrogen concentration at the depth of 0.50 μm was taken to be the nitrogen concentration of the base material (steel substrate).

A highest peak value (greatest value) among measured nitrogen concentration values within 0.05 μm of the steel surface was divided by the measured nitrogen concentration value at the depth of 0.50 μm and the resultant value was multiplied by a nitrogen concentration of the steel obtained by chemical analysis to give a value that was taken to be a nitrogen concentration peak value at a depth of within 0.05 μm of the surface. Nitrogen concentration peak values that were obtained are shown in Table 2.

(3) Evaluation of Corrosion Resistance

After brazing was carried out for each of the cold-rolled and annealed sheets, a 20 mm square test piece was sampled from a part to which brazing metal was not attached, and the test piece was covered by a sealing material, but leaving a 11 mm square measurement surface. Thereafter, the test piece was immersed in a 3.5% NaCl solution at 30° C. and a corrosion resistance test was conducted in accordance with JIS G 0577 with the exception of the NaCl concentration. Pitting corrosion potentials $V_{c'100}$ were measured and evaluated using the following standard. The evaluation results are shown in Table 2.

Good: the pitting potential $V_{c'100}$ was 150 (mV vs SCE) or more.

Poor: the pitting potential $V_{c'100}$ was less than 150 (mV vs SCE).

(4) Evaluation of Brazing Properties (a) Infiltration of Brazing Metal into Joint Gap As illustrated in FIG. 1, a 30 mm square sheet and a 25 mm×30 mm sheet were cut out from each of the cold-rolled and annealed sheets and these two sheets were overlapped and clamped in place using a clamp jig with a fixed torque force (170 kgf). Next, 1.2 g of a brazing metal was applied onto an end surface of one of the sheets and brazing was carried out. After the brazing, the degree to which the brazing metal had infiltrated between the sheets was visually confirmed from a side surface part of the overlapped sheets and was evaluated using the following standard. The evaluation results are shown in Table 2. Note that in the drawings, the reference sign 1 indicates the cold-rolled and annealed sheet and the reference sign 2 indicates the brazing metal.

Figure 2A:
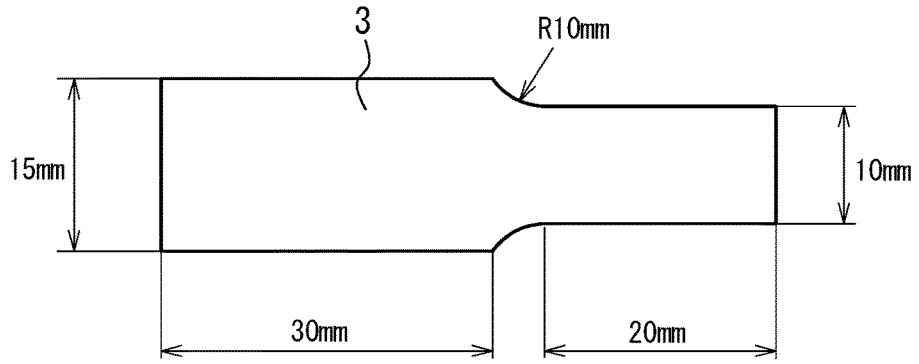
FIG. 2A illustrates one side of the tensile test piece prior to brazing and FIG. 2B illustrates the entire tensile test piece after brazing.
Figure 2B:
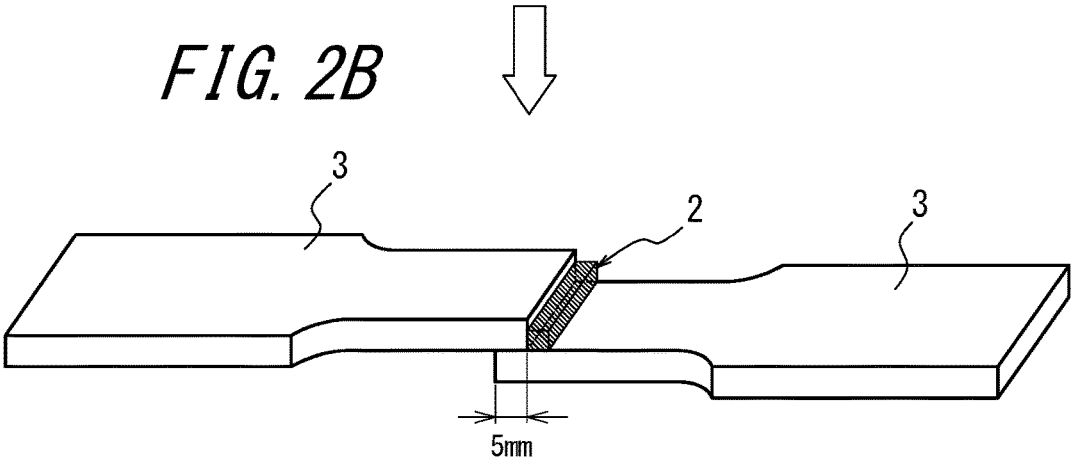

Excellent (pass, particularly good): Brazing metal infiltration to opposite end relative to application end Satisfactory (pass): Brazing metal infiltration over at least 50% and less than 100% of the overlapping length of the two sheets Unsatisfactory (fail): Brazing metal infiltration over at least 10% and less than 50% of the overlapping length of the two sheets Poor (fail): Brazing metal infiltration over less than 10% of the overlapping length of the two sheets (b) Joint Strength of Brazed Part As illustrated in FIG. 2, portions of a JIS No. 13B tensile test piece that had been split at the center thereof were overlapped by 5 mm and were clamped in place using a clamp jig. Next, brazing was carried out by applying 0.1 g of a brazing metal to an overlapping part of one of the portions. After the brazing, a tensile test was conducted at normal temperature and joint strength of the brazed part was evaluated using the following standard. The evaluation results are shown in Table 2. Note that in the drawings, reference sign 3 indicates the tensile test piece.

Excellent (pass, particularly good): No brazed part fracture even at 95% or greater of tensile strength of base material (base material part fracture)

Satisfactory (pass): Brazed part fracture at 95% or greater of tensile strength of base material Unsatisfactory (fail): Brazed part fracture at 50% or greater and less than 95% of tensile strength of base material Poor (fail): Brazed part fracture at less than 50% of tensile strength of base material In each evaluation of brazing properties described above, the brazing metal was a representative Ni-containing brazing metal BNi-5 (19% Cr and 10% Si in a Ni matrix) stipulated by Japanese Industrial Standards. The brazing was carried out in a sealed furnace. Furthermore, brazing was carried out in a high vacuum atmosphere of $10^{-2}$ Pa and was also carried out in an Ar carrier gas atmosphere by enclosing Ar with a pressure of 100 Pa after forming a high vacuum. A temperature pattern of the heat treatment involved performing treatment with a heating rate of 10° C./s, a first soaking time (step of equilibrating overall temperature) of 1800 s at 1060° C., a heating rate of 10° C./s, and a second soaking time (step of actually carrying out brazing at a temperature equal to or higher than the melting point of the brazing metal) of 600 s at 1170° C., followed by furnace cooling and purging of the furnace with external air (atmosphere) once the temperature had fallen to 200° C.

TABLE 1

| Steel | Chemical composition (mass %) | | | | | | | | | | | | | | | | |
|---|---|---|---|---|---|---|---|---|---|---|---|---|---|---|---|---|---|
| symbol | C | Si | Mn | P | S | Cr | Ni | Nb | Al | N | Mo | Cu | Ti | V | Ca | B | Remarks |
| A | 0.005 | 0.28 | 0.18 | 0.028 | 0.001 | 18.8 | 0.24 | 0.35 | 0.085 | 0.007 | 1.85 | — | — | — | — | — | Conforming steel |
| B | 0.004 | 0.39 | 0.21 | 0.023 | 0.001 | 23.2 | 0.19 | 0.31 | 0.101 | 0.009 | 1.06 | — | — | — | — | — | Conforming steel |
| C | 0.004 | 0.25 | 0.17 | 0.027 | 0.002 | 18.7 | 0.31 | 0.34 | 0.026 | 0.008 | 1.88 | — | — | 0.04 | — | 0.0003 | Conforming steel |

TABLE 1-continued

| Steel symbol | Chemical composition (mass %) | | | | | | | | | | | | | | | | Remarks |
|---|---|---|---|---|---|---|---|---|---|---|---|---|---|---|---|---|---|
| | C | Si | Mn | P | S | Cr | Ni | Nb | Al | N | Mo | Cu | Ti | V | Ca | B | |
| D | 0.006 | 0.39 | 0.21 | 0.023 | 0.001 | 23.2 | 0.19 | 0.34 | 0.094 | 0.009 | 1.06 | 0.05 | — | 0.05 | — | 0.0004 | Conforming steel |
| E | 0.007 | 0.19 | 0.23 | 0.027 | 0.001 | 18.9 | 0.32 | 0.30 | 0.011 | 0.009 | 1.81 | — | 0.08 | — | 0.0005 | — | Conforming steel |
| F | 0.005 | 0.13 | 0.11 | 0.025 | 0.002 | 22.7 | 0.38 | 0.33 | 0.141 | 0.007 | 1.13 | 0.21 | — | 0.12 | — | — | Conforming steel |
| G | 0.006 | 0.23 | 0.22 | 0.024 | 0.001 | 18.6 | 0.18 | 0.34 | 0.168 | 0.008 | 1.92 | — | — | — | — | — | Comparative steel |
| H | 0.008 | 0.23 | 0.27 | 0.026 | 0.001 | 15.6 | 0.11 | 0.32 | 0.019 | 0.008 | 1.05 | — | — | — | — | — | Comparative steel |
| I | 0.011 | 0.22 | 0.25 | 0.032 | 0.001 | 19.1 | 0.13 | 0.35 | 0.006 | 0.012 | — | 0.45 | — | 0.06 | — | 0.0005 | Conforming steel |
| J | 0.008 | 0.32 | 0.21 | 0.031 | 0.001 | 18.5 | 0.16 | 0.33 | 0.009 | 0.021 | 1.84 | — | — | — | — | — | Conforming steel |

TABLE 2

| No. | Steel symbol | Annealing conditions: Dew point in temperature range of 600° C. to 800° C. during heating (° C.) | Atmosphere of nitrogen-enriched layer creation treatment: $H_2$ (vol %) | $N_2$ (vol %) | Dew point (° C.) | Temperature of nitrogen-enriched layer creation treatment (° C.) | Time of nitrogen-enriched layer creation treatment (s) | Post-annealing pickling | Measurement/evaluation result: Ductility evaluation |
|---|---|---|---|---|---|---|---|---|---|
| 1 | A | −31 | 75 | 25 | −33 | 960 | 30 | not performed | Good |
| 2 | A | −26 | 75 | 25 | −33 | 960 | 30 | performed | Good |
| 3 | B | −41 | 75 | 25 | −45 | 970 | 60 | not performed | Good |
| 4 | C | −26 | 75 | 25 | −22 | 950 | 30 | not performed | Good |
| 5 | C | −39 | 75 | 25 | −48 | 960 | 30 | not performed | Good |
| 6 | C | −27 | 95 | 5 | −23 | 960 | 40 | performed | Good |
| 7 | C | −30 | 95 | 5 | −23 | 960 | 40 | not performed | Good |
| 8 | D | −38 | 75 | 25 | −42 | 970 | 30 | not performed | Good |
| 9 | E | −29 | 75 | 25 | −32 | 960 | 30 | not performed | Good |
| 10 | F | −50 | 75 | 25 | −55 | 960 | 30 | not performed | Good |
| 11 | A | −41 | 98 | 2 | −37 | 960 | 30 | not performed | Good |
| 12 | A | −17 | 75 | 25 | −18 | 960 | 30 | not performed | Good |
| 13 | C | −26 | 98 | 2 | −23 | 960 | 30 | not performed | Good |
| 14 | C | −38 | 75 | 25 | −44 | 880 | 30 | not performed | Poor |
| 15 | G | −28 | 75 | 25 | −31 | 960 | 30 | not performed | Good |
| 16 | H | −29 | 75 | 25 | −30 | 960 | 30 | not performed | Good |
| 17 | I | −34 | 75 | 25 | −41 | 950 | 40 | not performed | Good |
| 18 | J | −42 | 75 | 25 | −45 | 970 | 30 | not performed | Good |
| 19 | A | −30 | 10 | 90 | −28 | 890 | 60 | performed | Good |
| 20 | A | −15 | 75 | 25 | −31 | 960 | 30 | not performed | Good |

| No. | Measurement/evaluation result: Nitrogen concentration peak value of nitrogen-enriched layer (mass %) | Corrosion resistance properties evaluation | Brazing properties evaluation (brazing in high vacuum): Brazing metal infiltration | Brazed part joint strength | Brazing properties evaluation (brazing in Ar atmosphere): Brazing metal infiltration | Brazed part joint strength | Remarks |
|---|---|---|---|---|---|---|---|
| 1 | 0.05 | Good | Satisfactory | Satisfactory | Satisfactory | Satisfactory | Example |
| 2 | 0.05 | Good | Satisfactory | Satisfactory | Satisfactory | Satisfactory | Example |
| 3 | 0.22 | Good | Excellent | Satisfactory | Satisfactory | Satisfactory | Example |
| 4 | 0.03 | Good | Satisfactory | Satisfactory | Satisfactory | Satisfactory | Example |
| 5 | 0.17 | Good | Excellent | Excellent | Excellent | Excellent | Example |
| 6 | 0.08 | Good | Satisfactory | Satisfactory | Satisfactory | Satisfactory | Example |
| 7 | 0.06 | Good | Satisfactory | Satisfactory | Satisfactory | Satisfactory | Example |
| 8 | 0.13 | Good | Satisfactory | Satisfactory | Satisfactory | Satisfactory | Example |
| 9 | 0.09 | Good | Excellent | Excellent | Excellent | Excellent | Example |
| 10 | 0.25 | Good | Excellent | Excellent | Excellent | Excellent | Example |
| 11 | 0.01 | Good | Poor | Poor | Poor | Poor | Comparative Example |
| 12 | 0.01 | Good | Poor | Poor | Poor | Poor | Comparative Example |
| 13 | 0.01 | Good | Poor | Poor | Poor | Poor | Comparative Example |
| 14 | 0.01 | Poor | Poor | Poor | Poor | Poor | Comparative Example |
| 15 | 0.28 | Good | Poor | Poor | Poor | Poor | Comparative Example |
| 16 | 0.08 | Poor | Excellent | Satisfactory | Satisfactory | Satisfactory | Comparative Example |
| 17 | 0.18 | Good | Excellent | Excellent | Excellent | Excellent | Example |
| 18 | 0.20 | Good | Excellent | Excellent | Excellent | Excellent | Example |
| 19 | 0.05 | Good | Satisfactory | Satisfactory | Satisfactory | Satisfactory | Example |
| 20 | 0.02 | Good | Poor | Poor | Poor | Poor | Comparative Example |

Table 2 shows that for each of Examples 1-10 and 17-19, infiltration of the brazing metal into the joint gap was good and joint strength of the brazed part was good. Accordingly, it was demonstrated that Examples 1-12 display good brazing properties even when a Ni-containing brazing metal is used. Furthermore, Examples 1-12 had good corrosion resistance and ductility.

In contrast, good brazing properties and/or good corrosion resistance were not obtained in Comparative Examples 11-16 and 20 for which the chemical composition or the nitrogen concentration peak value was outside of the appropriate range.

INDUSTRIAL APPLICABILITY

The present disclosure enables a ferritic stainless steel to be obtained that can be suitably used for heat exchanger components and the like of exhaust heat recovery units and EGR coolers that are assembled by brazing, and is therefore extremely useful in industry.

REFERENCE SIGNS LIST

1 cold-rolled and annealed sheet
2 brazing metal
3 tensile test piece

The invention claimed is:

1. A ferritic stainless steel comprising
a chemical composition consisting of, in mass %:
0.003% to 0.020% of C;
0.05% to 1.00% of Si;
0.10% to 0.50% of Mn;
0.04% or less of P;
0.01% or less of S;
16.0% to 25.0% of Cr;
0.05% to 0.60% of Ni;
0.25% to 0.45% of Nb;
0.005% to 0.15% of Al;
0.005% to 0.025% of N; and
at least one selected from 0.50% to 2.50% of Mo and 0.05% to 0.80% of Cu,
the balance being Fe and incidental impurities, wherein
a nitrogen-enriched layer is present that has a nitrogen concentration peak value of 0.03 mass % to 0.30 mass % at a depth of within 0.05 μm of a surface of the steel.

2. A ferritic stainless steel comprising
a chemical composition consisting of, in mass %:
0.003% to 0.020% of C;
0.05% to 1.00% of Si;
0.10% to 0.50% of Mn;
0.04% or less of P;
0.01% or less of S;
16.0% to 25.0% of Cr;
0.05% to 0.60% of Ni;
0.25% to 0.45% of Nb;
0.005% to 0.15% of Al;
0.005% to 0.025% of N; and
at least one selected from 0.50% to 2.50% of Mo and 0.05% to 0.80% of Cu, and
one or more of:
0.005% to 0.10% of Ti;
0.01% to 0.20% of V;
0.0003% to 0.0030% of Ca; and
0.0003% to 0.0030% of B, and
the balance being Fe and incidental impurities, wherein
a nitrogen-enriched layer is present that has a nitrogen concentration peak value of 0.03 mass % to 0.30 mass % at a depth of within 0.05 μm of a surface of the steel.

3. A method for producing the ferritic stainless steel of claim 1, the method comprising:
hot rolling a slab having the chemical composition of claim 1 to form a hot-rolled sheet;
performing hot-rolled sheet annealing on the hot-rolled sheet according to need; and
performing a combination of cold rolling and annealing on the hot-rolled sheet one or more times,
wherein the sheet after subjection to the cold rolling is heated in final annealing after the cold rolling with a dew point of an atmosphere in a temperature range of 600° C. to 800° C. being −20° C. or lower, and subjected to a nitrogen-enriched layer creation treatment at a temperature of 890° C. or higher in an atmosphere of 20° C. or lower in dew point and 5 vol % or more in nitrogen concentration.

4. A method for producing the ferritic stainless steel of claim 2, the method comprising:
hot rolling a slab having the chemical composition of claim 2 to form a hot-rolled sheet;
performing hot-rolled sheet annealing on the hot-rolled sheet according to need; and
performing a combination of cold rolling and annealing on the hot-rolled sheet one or more times,
wherein the sheet after subjection to the cold rolling is heated in final annealing after the cold rolling with a dew point of an atmosphere in a temperature range of 600° C. to 800° C. being −20° C. or lower, and subjected to a nitrogen-enriched layer creation treatment at a temperature of 890° C. or higher in an atmosphere of −20° C. or lower in dew point and 5 vol % or more in nitrogen concentration.

* * * * *